US006578804B2

(12) United States Patent
Lin et al.

(10) Patent No.: US 6,578,804 B2
(45) Date of Patent: Jun. 17, 2003

(54) SECURING DEVICE FOR POSITIONING A SEAT POST OF OFFICE CHAIRS

(76) Inventors: Ming Chuan Lin, 11F-2, No. 43, Chai-I Street, Taichung City (TW); Jack Wang, 4F, No. 357, Da-Na Road, Su-Lin, Taipei City (TW)

( * ) Notice: Subject to any disclaimer, the term of this patent is extended or adjusted under 35 U.S.C. 154(b) by 0 days.

(21) Appl. No.: 09/875,859

(22) Filed: Jun. 8, 2001

(65) Prior Publication Data

US 2002/0185574 A1 Dec. 12, 2002

(51) Int. Cl.[7] ..... F16M 11/20

(52) U.S. Cl. ..... 248/188.7; 248/188.1; 248/519; 403/373; 403/374.3

(58) Field of Search ..... 248/188.1, 188.7, 248/519; 403/365, 366, 367, 370, 373, 374.1, 374.2, 374.3

(56) References Cited

U.S. PATENT DOCUMENTS 1,817,558 A * 8/1931 Harter ..... 248/188.7
1,817,559 A * 8/1931 Harter ..... 108/138
2,673,590 A * 3/1954 Hamilton ..... 248/410
2,939,514 A * 6/1960 Buettner et al. ..... 248/408
3,195,848 A * 7/1965 Miller et al. ..... 248/411
4,140,413 A * 2/1979 Conrad ..... 403/370
4,185,808 A * 1/1980 Donohoe et al. ..... 248/295.11
4,238,097 A * 12/1980 Clausen et al. ..... 248/188.7
4,639,036 A * 1/1987 Nichols ..... 297/184.15
4,997,054 A * 3/1991 Denny et al. ..... 180/331
5,749,622 A * 5/1998 Tseng ..... 297/195.1
5,758,856 A * 6/1998 Carnahan et al. ..... 248/523
5,775,709 A * 7/1998 Chen ..... 280/279
5,816,556 A * 10/1998 Liao ..... 248/405
6,155,743 A * 12/2000 Chen ..... 403/374.1

* cited by examiner

*Primary Examiner*—Peter M. Cuomo
*Assistant Examiner*—Joseph Edell
(74) *Attorney, Agent, or Firm*—Charles E. Baxley

(57) ABSTRACT

An office chair includes a seat with a seat post which is movably inserted into a base. The base has a plurality of legs extending therefrom and a recess is defined in a top of the tube. Two clamp members are connected by two expandable members which bias the clamp members in opposite directions. A cover is mounted to the base and the seat post extends through the cover. The seat post is clamped by the two clamp members and a releasing member extends through the cover and the hole in the tube and engages with one of the two clamp members.

3 Claims, 3 Drawing Sheets

SECURING DEVICE FOR POSITIONING A SEAT POST OF OFFICE CHAIRS

FIELD OF THE INVENTION

The present invention relates to a securing device comprising two clamp members with two expanding members are connected therebetween and a seat post is clamped between the two clamp members. A releasing member is engaged with one of the clamp members.

BACKGROUND OF THE INVENTION

A conventional office chair generally includes a securing device that controls the position of the seat. The conventional securing device involves a hydraulic cylinder and the seat post is connected to the piston rod of the cylinder so that when the users operate the hydraulic cylinder, the seat post is lowered or raised by the movement of the piston rod. However, the cylinder is expensive and has a potential problem of leakage of the liquid in the cylinder. Besides, the number of parts composing the cylinder is large and every part has to be machined to have suitable holes. All of these make the office chair to have a high price and cannot be popular for most of the customers. In other words, there are no office chairs, in the market having adjustable height of the seat and sold at lower price.

The present invention intends to provide an office chair that has a securing device for holding the seat post and the securing device includes a simple structure.

SUMMARY OF THE INVENTION

In accordance with one aspect of the present invention, there is provided an office chair and comprises a seat with a seat post extending from an underside of the seat. A base has tube and a plurality of legs extend from the tube. A recess is defined in the tube and a securing device is received in the recess. The securing device comprises two clamp members which are connected by two expandable members which bias the clamp members in opposite directions. A cover is mounted to the base and the seat post extends through the cover and clamped by the two clamp members. A releasing member extends through the cover and engages with one of the two clamp members.

The primary object of the present invention is to provide an office chair that has a seat height adjustable feature and the mechanism for controlling the seat post is simple.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
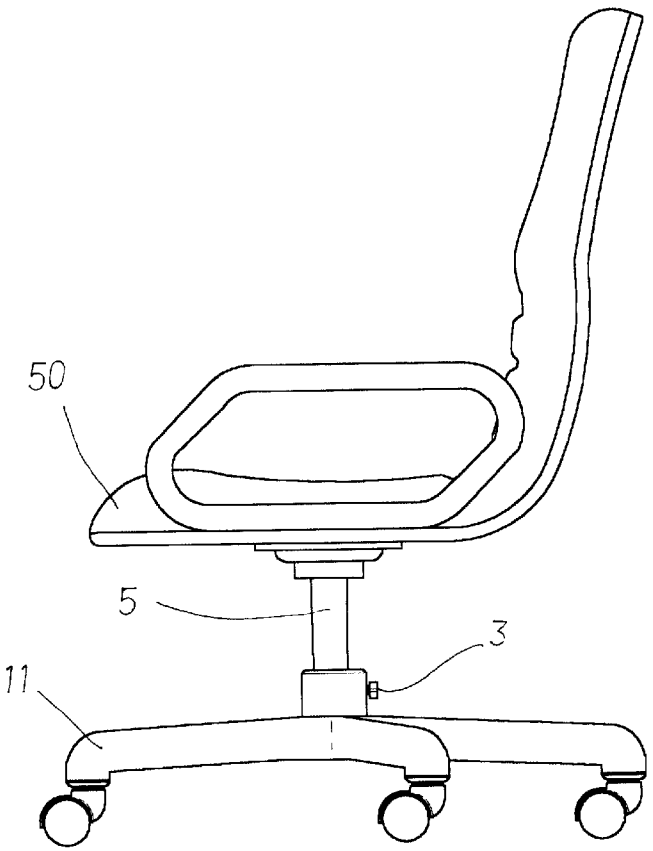
FIG. 1 is a plan view to show an office chair of the present invention.
Figure 2:
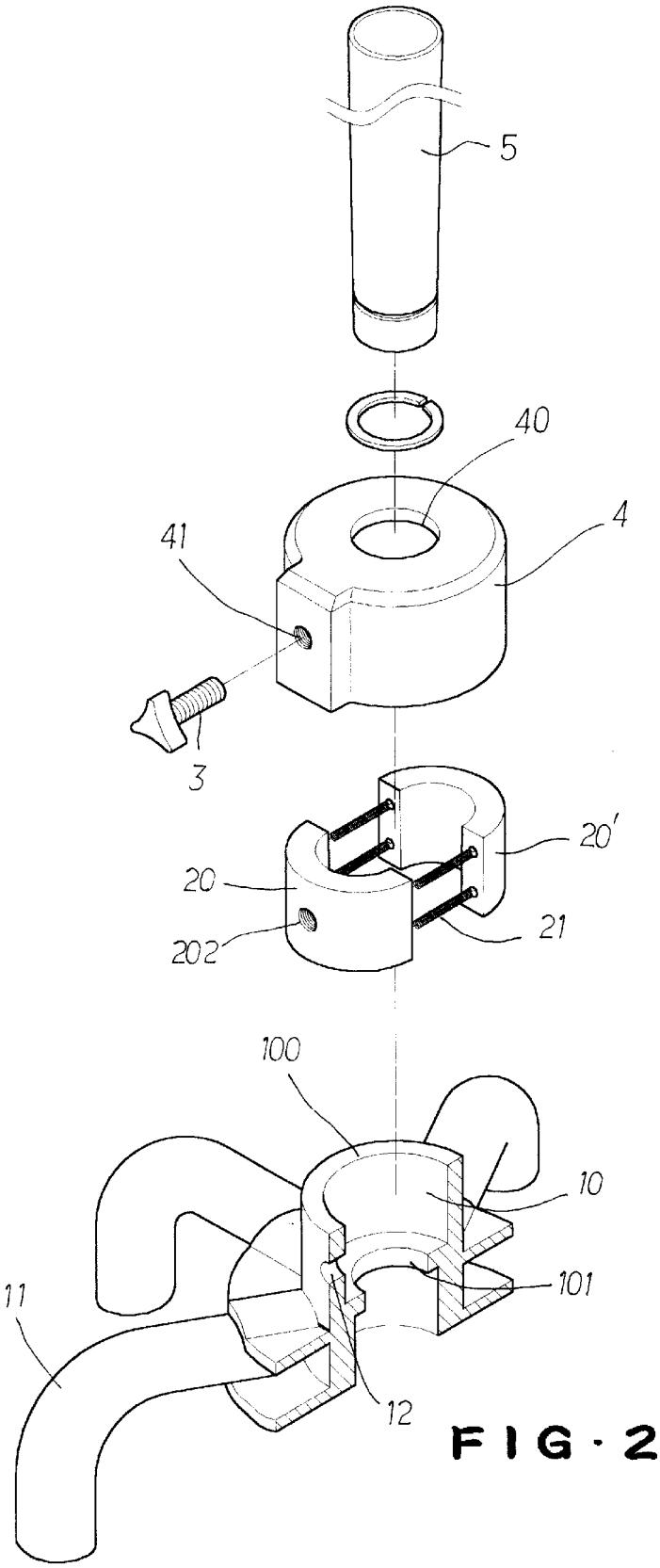
FIG. 2 is an exploded view to show the securing device for clamping the seat post of the chair of the present invention.
Figure 3:
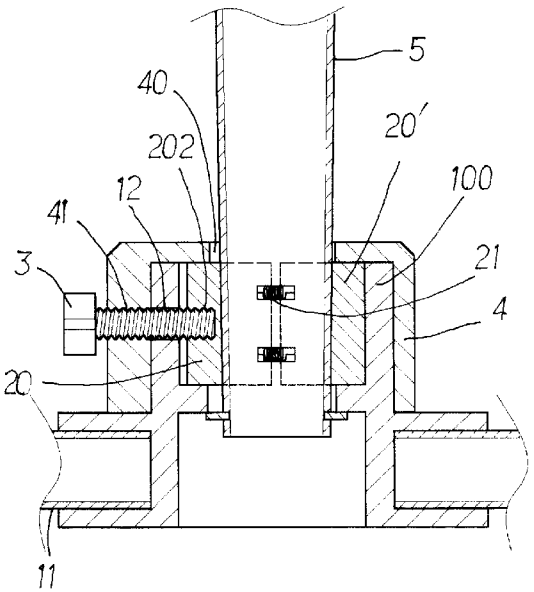
FIG. 3 is a cross sectional view to show the seat post is clamped by the securing device.

Referring to FIGS. 1 to 3, the office chair of the present invention comprises a seat 50 with a seat post 5 extending from an underside of the seat 50. A base has a tube 100 and a plurality of legs 11 extend from the tube 100. A recess 10 is defined in a top of the tube 100 and a flange 101 extends inward from an inner periphery of the recess 10. A hole 12 is defined through the tube 100 and communicates with the recess 10.

A cover 4 is mounted to the top of the tube 100 and the seat post 5 extends through a hole 40 of the cover 4 and a central hole in the flange 101. A securing in device is received in the recess 10 and comprises two clamp members 20, 20' which are connected by two expandable members 21 which bias the clamp members 20, in opposite directions. The two clamp members 20, 20' are rested on the flange 101. The seat post 5 is clamped by the two clamp members 20, 20'. The seat post 5 has a tapered outer periphery and each of the two clamp members 20, 20' has a tapered inside.

A releasing member 3 which is a bolt extends through a side hole 41 of the cover 4 and the hole 12 in the tube 100 and engages with a threaded recess 202 defined in one of the two clamp members 20, 20'. The clamp member 20' is pushed to contact the inner periphery of the recess 10 and the other clamp member 20 is pushed by the releasing member 3 to clamp the seat post 5.

Figure 4:
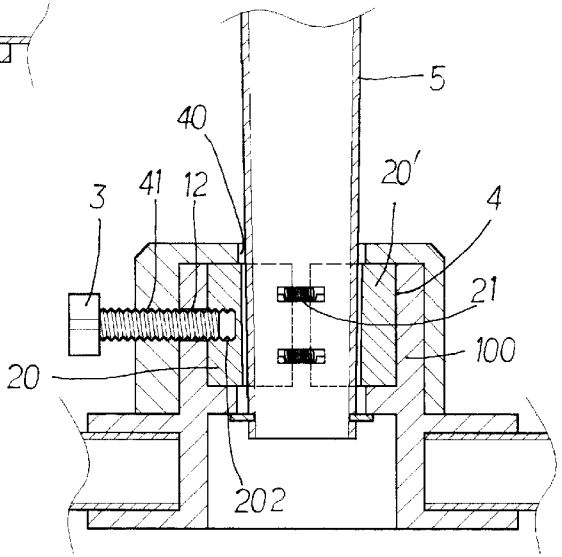
FIG. 4 is a cross sectional view to show that the releasing member is unscrewed and the seat post is not clamped by the securing device.
Figure 5:
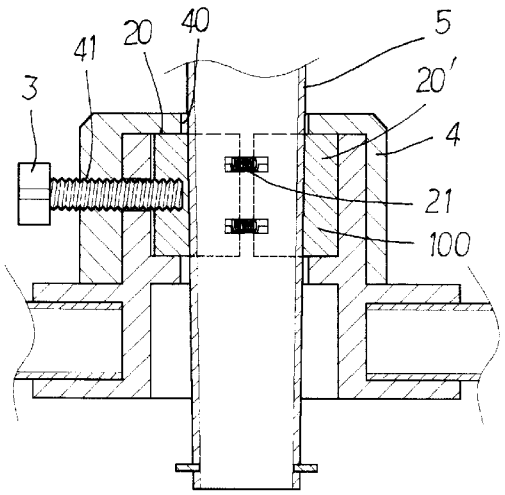
FIG. 5 is a cross sectional view to show the seat post is lowered and re-clamped by the securing device.

A shown in FIG. 4, when adjusting the height of the seat 50, the releasing member 3 is unscrewed so that the clamp member 20 is biased by the expandable members 21 and moves away from the other clamp member 20'. The seat post 5 is then moved freely till the releasing member 3 is threaded again to push the clamp member 20 to clamp the seat post 5 again. The tapered outer periphery of the seat post 5 and the tapered inside of each of the two clamp members 20, 20' allow the users to effectively secure the seat post 5 in position. Other known methods may be used to clamp the seat post 5 such as by cam device to clamp the two clamp members.

While we have shown and described the embodiment in accordance with the present invention, it should be clear to those skilled in the art that further embodiments may be made without departing from the scope of the present invention.

What is claimed is:

1. An office chair comprising:

a seat with a seat post extending from an underside of said seat;

a base having a tube and a recess defined in said tube, a plurality of legs extending from said base and a hole defined through said tube;

a securing device received in said recess and comprising two clamp members connected by two expandable members which bias said two clamp members in opposite directions, said seat post clamped by said two clamp members, and a cover mounted to said base and said seat post extending through said cover, a releasing member extending through said cover and a wall of the tube so as to engage with one of said two clamp members, wherein said seat post has a tapered outer periphery and each of said two clamp members has a tapered inside.

2. The office chair as claimed in claim 1, wherein said releasing member is a bolt and one of said two clamp members has a threaded recess so that said bolt engaged with said threaded recess.

3. The office chair as claimed in claim 1 further comprising a flange extending inward from an inner periphery of said recess and said two clamp members rested on said flange.

* * * * *